United States Patent [19]

Begey

[11] 3,997,188

[45] Dec. 14, 1976

[54] SAFETY SKI BINDING

[75] Inventor: Jean-Marie Begey, Cluses, France

[73] Assignee: Garcia Corporation, Teaneck, N.J.

[22] Filed: Sept. 23, 1975

[21] Appl. No.: 615,900

[30] Foreign Application Priority Data

Oct. 14, 1974 France ..... 74.34524

[52] U.S. Cl. ..... 280/613; 280/618; 280/637

[51] Int. Cl.[2] ..... A63C 9/08

[58] Field of Search ..... 280/11.35 N, 11.13 B, 280/11.13 C, 11.13 D, 11.35 R, 11.35 A, 11.35 D, 11.35 T, 637, 613, 618

[56] References Cited

UNITED STATES PATENTS

| | | | |
|---|---|---|---|
| 3,101,201 | 8/1963 | Hall | 280/11.35 A |
| 3,158,385 | 11/1964 | Hall | 280/11.35 A |
| 3,822,070 | 7/1974 | Salomon | 280/11.35 N |
| 3,844,575 | 10/1974 | Salomon | 280/11.35 N |
| 3,871,674 | 3/1975 | Bunn, Jr. | 280/11.35 N |
| 3,893,682 | 7/1975 | Weinstein et al. | 280/11.35 N |

FOREIGN PATENTS OR APPLICATIONS

| | | | |
|---|---|---|---|
| 227,994 | 10/1943 | Switzerland | 280/11.35 N |
| 295,705 | 3/1954 | Switzerland | 280/11.35 T |

*Primary Examiner*—M. H. Wood, Jr.
*Assistant Examiner*—Milton L. Smith
*Attorney, Agent, or Firm*—Fitzpatrick, Cella, Harper & Scinto

[57] ABSTRACT

A safety ski binding comprises a sole grip pivoted on an end of a sole-supporting plate elastically connected to the ski by a flexible cable tensioned by a spring winder incorporated in the plate. A device for automatically opening the sole grip, after removal of the sole grip from the ski by withdrawal of the cable but before the cable is fully withdrawn, comprises a projection on the winder which actuates a lever to pull or push a transmission member which either disengages a bolt retaining the heel grip, or directly tips the grip open against the action of a biasing spring.

8 Claims, 7 Drawing Figures

SAFETY SKI BINDING

The invention relates to safety ski bindings of the type comprising at least one sole-gripping member supported on the end of a sole-supporting plate elastically retained to a ski by at least one flexible cable cooperating with an elastic cable-tensioning device incorporated in the sole-supporting plate.

In known ski bindings of this type, sold under the Trademark "Burt", each end of the sole-supporting plate is secured to the ski by a flexible cable of which one end is connected to the ski and the other end to a spring-urged winder in the sole-supporting plate which constantly tends to wind in the cable to hold the plate on the ski.

A sole-gripping member on the rear end of the sole-supporting plate is held in a closed boot-gripping position by a strong spring bolt. The spring bolt is not designed to form a safety release to ordinarily permit release of the boot sole in the case of an accident, but merely to release in exceptional circumstances, for example if the ski suddendly becomes immobilized by penetration in the snow so that one of the flexible cables retaining the boot-supporting plate becomes completely unwound; when the limit of unwinding is reached, there is an abrupt tautening of the cable which involves a violent shock. Only when the cable is subjected to such an abrupt tautening can the spring bolt release, since its spring is relatively strong. This is a major disadvantage of these bindings since the wound spring-urged flexible cable can only have a limited length and this inevitably causes the production of an abrupt tautening following normal opening of the binding, and the shock produced is liable in some circumstances to be so great as to produce injury to the skier or even breakage of the ski.

An aim of the invention is therefore to avoid this drawback, by providing means for releasing the boot from the sole-supporting plate when this plate has separated from the ski by an amount at which the flexible cable is not fully extended and therefore before it may become abruptly tautened. The consequent risk of abrupt shocks and possible injury or damage is thus avoided.

According to the invention, a ski binding of the mentioned type comprises a device for automatically opening the sole-gripping member, and arranged for actuation after operation of the safety release device by withdrawal of the flexible cable but before the cable becomes fully withdrawn i.e. before the limit of movement of the sole-supporting plate relative to the ski. This automatic opening device comprises basically a mobile part of the cable-tensioning device cooperating with a part of the sole gripping member to open it before said limit of movement of the sole-supporting plate. Said part of the sole gripping member may also cooperate with a mobile part of a second cable-tensioning device which tensions a second cable connecting the other end of said plate to the ski. Said mobile part(s) of the cable tensioning device(s) may each be connected to said part of the sole-gripping member by transmission means such as a traction-actuable flexible cable or a traction or a pressure-actuable rigid member.

In some embodiments, said part of the sole-gripping member may carry a pivoting axis of said member, said part being positively held with said member in a sole-retaining position by a bolt which opens as a winding drum of the tensioning device approaches its extreme wound-out position to free the sole-gripping member which can pivot open to release a held boot. In this case, said sole-gripping member may comprise a lever pivoted on the binding casing, and a sole-grip pivoted on this lever, the bolt cooperating with said lever.

In another embodiment, said transmission means may include a cable which directly acts on the sole-gripping member to pivot it open against the action of a biasing spring.

Several embodiments of the invention are shown, by way of example, with reference to the accompanying drawings, in which.

Figure 1:
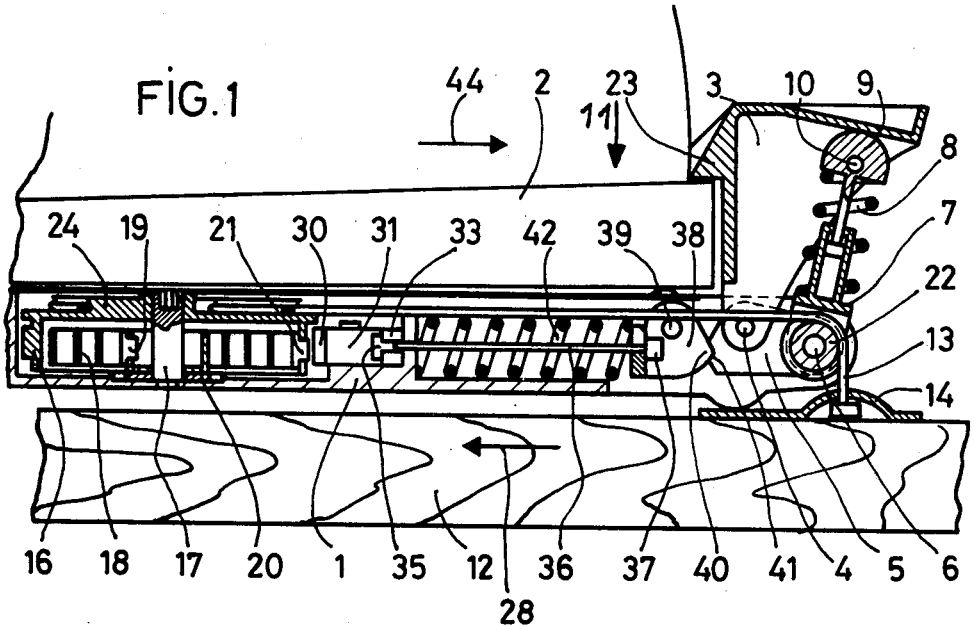
FIG. 1 is a cross-section of a first embodiment, shown in a closed position holding a boot on a ski.
Figure 2:
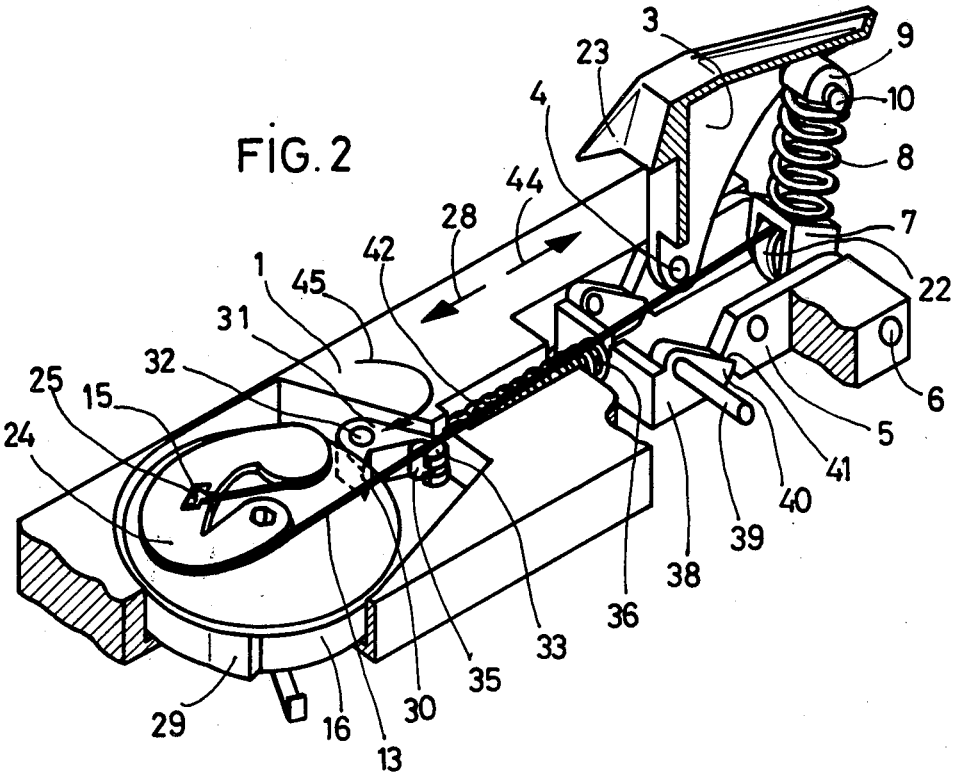
FIG. 2 is a partly-cut away schematic perspective view of the embodiment of FIG. 1.
Figure 3:
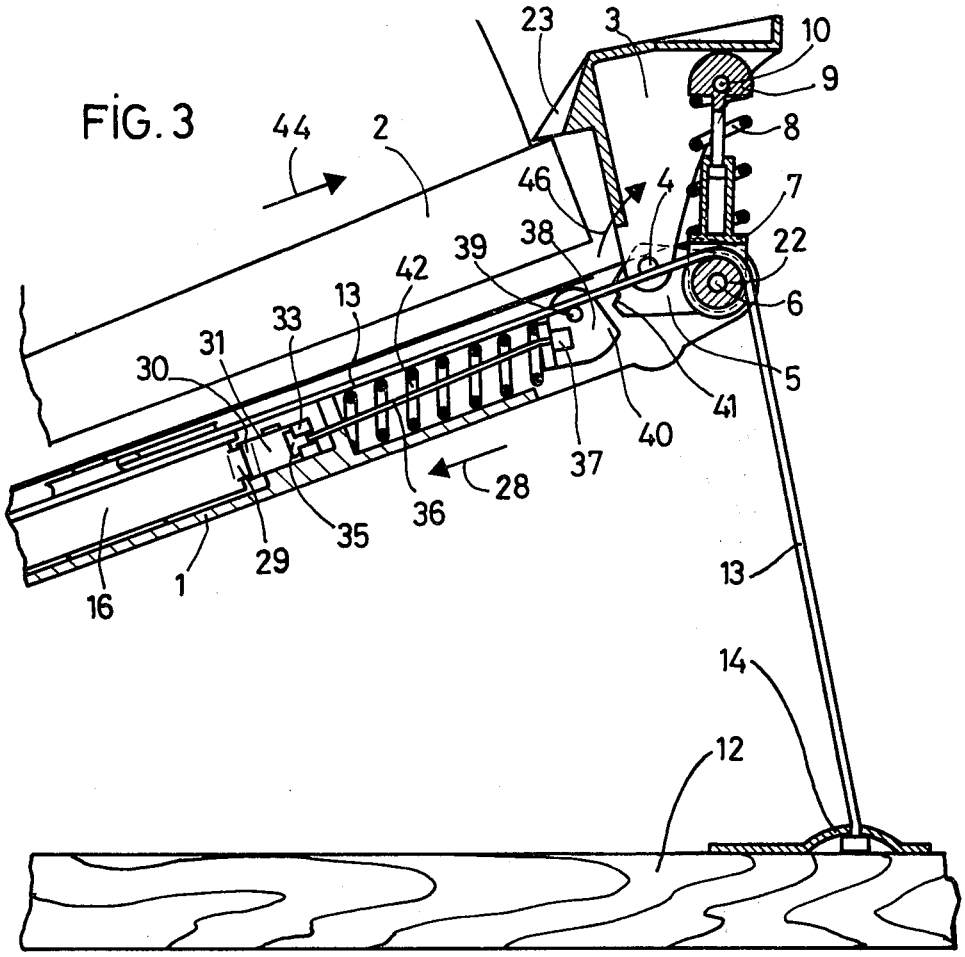
FIG. 3 is a cross-section of the same embodiment in an open position during release of a boot.

The first embodiment shown in FIGS. 1 to 3 comprises a boot-sole supporting plate 1 to which the sole 2 of a boot is secured during normal skiing by a sole-grip 3 which, in the example, is mounted on the rear end of plate 1. Grip 3 is pivoted on a pin 4 on a pair of levers 5 themselves pivoted on a transverse shaft 6 supported by plate 1. On shaft 6 is also provided a yoke 7 which supports one end of a compression coil spring 8 whose other end bears against an element 9 pivoted by a pin 10 on grip 3. Under the action of spring 8, grip 3 is permanently biased in direction 11 so that its jaw 23 grips sole 2 and holds it down on plate 1.

The sole-supporting plate 1 is connected to ski 12 by a flexible cable 13 of which one end is fixed to ski 12 by a securing plate 14 and the other end is connected to a tensioning device. In the example shown, this tensioning device includes a drum 16 pivoted about a shaft 17. Drum 16 houses a spiral spring 18 with an inner end 19 attached to a piece 20 fixed for rotation with shaft 17, and an outer end 21 hooked onto an inner projection of drum 16. From the securing plate 14, cable 13 passes over a pulley 22 pivoted on shaft 6 between the arms of yoke 7, then passes around a spiral groove about a winder 24 integral with the top of drum 16, and terminates with an enlarged end 15 engaged in a recess 25. This tensioning device tends to constantly exert a tension cable 13 in direction 28, and hence constantly biases the plate 1 onto ski 12.

The drum 16 also has on its outer cylindrical wall a step-like projection 29. In the path of projection 19 is an end 30 of a lever 31 pivoted on plate 1 about a pin 32. The lever 31 has a second end 33 to which is attached one end 35 of a cable 36 whose other end 37 is fixed to a double tipping bolt 38 pivoted on plate 1 about a transverse shaft 39. During skiing, two pointed ends 40 of bolt 38 engage in respective notches 41 of levers 5, where they are held by a compression coil spring 42 which constantly pushes bolt 38 in direction 44 and simultaneously, by cable 36, pulls the end 33 of lever 31 in the same direction. The elements of the binding are thus all in the normal or "closed " position shown in FIGS. 1 and 2.

In the event of a fall of the skier, the plate 1 is able to move with the boot away from ski 12 to avoid injury to the skier's leg. In the example shown, the rear of plate 1 can move in this manner, upwards or laterally.

If the force having produced this displacement of plate 1 is relatively weak and produces only a partial unwinding of cable 13, the plate 1 and ski 12 are pulled back together again by the cable 13 as soon as the force ceases.

For a relatively great force, for example if the ski abruptly penetrates and becomes fixed in the snow, the cable 13 unwinds almost completely until the projection 29 of drum 16 comes to contact end 30 of lever 31 and pivots it in direction 45. The second end 33 of lever 31 thus pulls cable 36 in direction 28 and the end 37 of this cable tips lock 38 downwardly (FIG. 3) against the action of spring 42. The ends 40 thus disengage from notches 41 and levers 5 are free to tip up in direction 46 (FIG. 3). Under the pulling action exerted by the boot heel, the pivoting pin 4 of grip 3 moves up until jaw 23 frees the boot sole 2. During tipping of levers 5 in direction 46, the various elements are in the position shown in FIG. 3. Freeing of the sole 2 is thus produced before the end of possible movement of the plate 1 from the ski 12, i.e. before the cable 13 is fully unwound. Consequently the skier's leg and the ski do not have to support any brutal shock since there can be no abrupt tautening of cable 13.

When the force which removed plate 1 from ski 12 ceases, the plate 1 is once more applied onto ski 12 by winding in of cable 13, the projection 29 freeing lever 31. It then suffices for the skier to once more lock ends 40 in notches 41 by downwardly acting on jaw 23. The binding is then ready to receive a boot.

It is to be noted that the spring 42 may be very weak; it suffices that this spring be able to return the bolt 38 and lever 31 back to the position of FIG. 1 so that the notches 41 can once more engage with ends 40 before re-fitting a boot. It is however possible to make this spring somewhat stronger so that the boot does not unwantedly become removed from plate 1 after a fall which has produced separation of the plate 1 from ski 12, but not the boot from plate 1, when for example the skier may as he is trying to lift himself up involuntarily exert a moderate tension on the withdrawn cable 13 sufficient to fully withdraw the cable. In this case, the grip 3 will only be opened if the skier exerts a fairly considerable tension on the cable 13, sufficient to overcome the resistance provided by spring 42. The same remark also applies to the equivalent springs in the modification of FIG. 4 and the embodiment of FIGS. 5 and 6.

Figure 4:
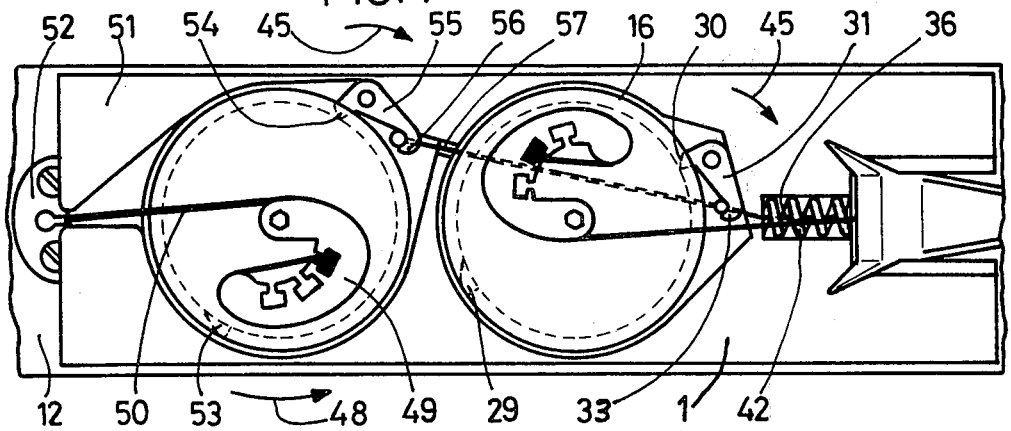
FIG. 4 is a schematic plan view of a variation of the first embodiment.

FIG. 4 shows a modification of the first embodiment in which the sole-supporting plate 1 incorporates a second tensioning device 49 with a second cable 50 holding the other end 51 of plate 1 (in our example the front end) to ski 12. One end of cable 50 is secured to ski 12 by a plate 52. The drum of device 49 includes a step-like projection 53, similar to projection 29 of drum 16. In the trajectory of projection 53 is the first end 54 of a lever 55, similar to lever 31. To a second end 55 of lever 55 is hooked an extension 57 of the previously described cable 36. Extension 57 could alternatively be a separate cable quite independent of cable 36.

If the rear of plate 1 is raised or displaced laterally, the first tensioning device operates as previously described. However, if the front 51 of plate 1 is raised or laterally displaced relative to ski 12, the first drum 16 remains stationary and the second tensioning device 49 unwinds the second cable 50. After a certain rotation of device 49 in direction 48, projection 53 abuts the first end 54 of lever 55 and the second end 56 exerts a traction on cable extension 57. The sole 2 is then freed as previously, by tipping of the same lock 38 (FIG. 3). This modification thus permits opening of sole grip 3 whatever be the direction of displacement of plate 1 relative to the ski, this opening being produced only after a given displacement of the plate 1, before full withdrawal of the respective cable 13 or 50.

In the first embodiment and the described modification, a traction operated flexible cable (36,36/57) acts as transmission element between the mobile part (16,29; 49,53) of each tensioning device and a part of the sole-grip mechanism. This cable could alternatively be replaced by a traction-operated rigid transmission element such as a rod.

Figure 5:
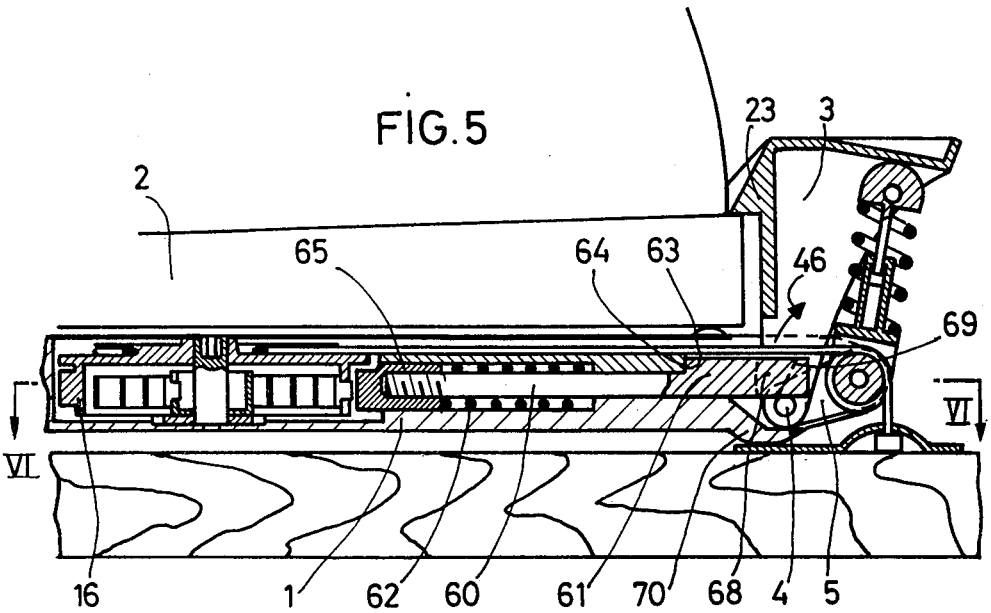
FIG. 5 is a cross-section along line V—V of FIG. 6 showing a second embodiment in a closed position holding a boot on a ski.
Figure 6:
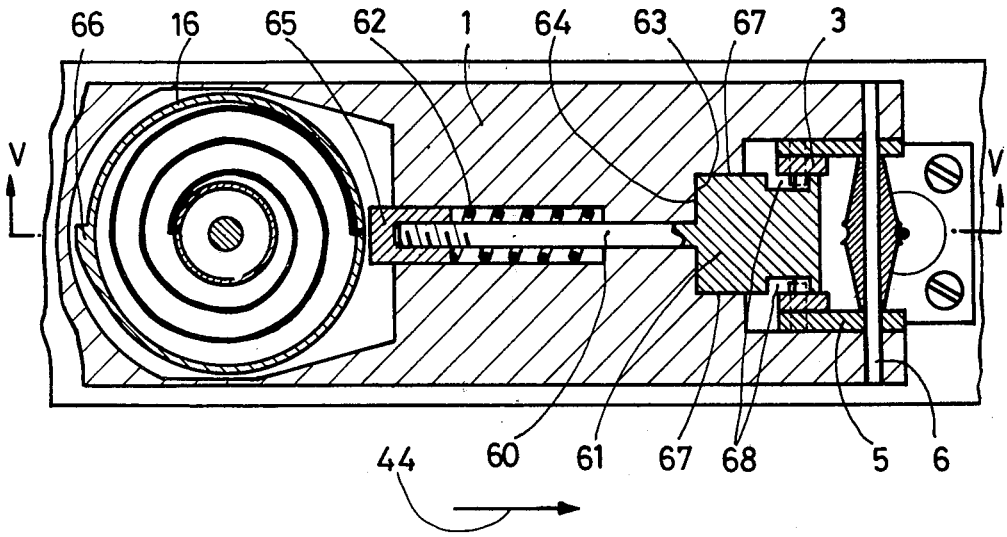
FIG. 6 is a cross-section along line VI—VI of FIG. 5.

In the second embodiment shown in FIGS. 5 and 6, the corresponding transmission element is a rigid push-operating element. Hence, the previous cable 36 cooperating with a tipping bolt 38 is replaced by a push rod 60 integral with a bolt 61. A compression coil spring tends to cnstantly bias a face 63 of bolt 61 against a face 64 of plate 1. A nut 65 screwed on the end of rod 60 is disposed in the trajectory of a progressively-inclined ramp 66 on the periphery of drum 16, this ramp replacing the projection 29 of the previous embodiment. Levers 5 no longer have a notch 41; in the locked or closed position (FIGS. 5 and 6) the end of each pin 4 engages the lower face of bolt 61 and above a face 70 of plate 1. The lateral faces 67 if bolt 61 each include grooves 68, for example of arcuate shape. These grooves 68 are positioned so that when the nut 65 of push rod 60 comes to bear on the upper or outermost surface 66, grooves 68 are disposed facing the ends of shafts 4. All of the other elements are identical to those of the first embodiment, and are designated by the same reference numerals.

Hence, in use, the plate 1 and boot sole 2 may move away from ski 12 until the moment when ramp 66 pushes rod 60 and bolt 61 in direction 44. When the grooves 68 come into alignment with the ends of pins 4, these pins 4 are free to move up along these grooves 68 as indicated by 46 (FIG. 5) under the action of the force exerted in this direction by the boot sole 2 acting on jaw 23, until the boot is freed. Bolt 61 and push rod 60 move back to the position of FIG. 5 as soon as the nut 65 moves off of ramp 66. The skier then merely has to tip down the sole grip 3 in the direction opposite to 46; this involves action of pins 4 on curved surfaces 69 in grooves 68 to displace lock 61 in direction 44 until the pins 44 arrive in their initial position (of FIG. 5) under bolt 61 and resting on face 70. A boot can then once more be fitted in the binding.

Figure 7:
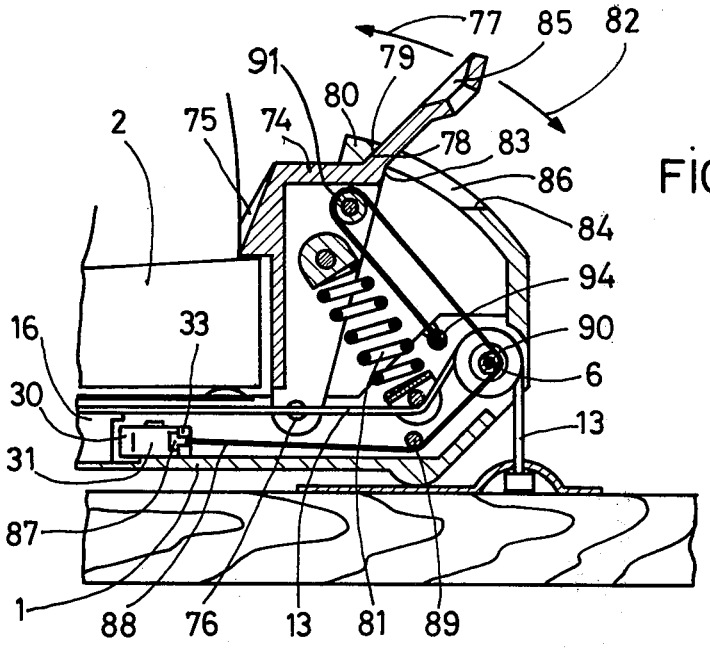
FIG. 7 is a cross-section of part of a third embodiment, in closed position holding a boot on a ski.

FIG. 7 shows a third embodiment in which the part of the heel-grip mechanisim cooperating, via a transmission element, with the mobile part of the cable-tensioning device is the heel-grip itself, rather than a bolt retaining this jaw.

In this embodiment, drum 16 once more includes a projection (as 29 of FIG. 1) cooperating with an end 30 of lever 31. The tensioning device of drum 16 is the same as for the first embodiment. However, the sole-grip 74 is different; it comprises a jaw 75 pivoted on sole-supporting plate 1 by a pin 76. Pivoting of jaw 75 in direction 77 is limited by a stop 78 of jaw 75 which abuts a corresponding abutment 79 on a casing 80 fixed on plate 1 to define the rest or closed position of the jaw. A compression coil spring 81 constantly biases jaw 75 towards this closed position. Pivoting of jaw 75 in direction 82 is limited by a stop 83 of the jaw which is in the open position (not shown) of the jaw abuts a corresponding abutment 84 on casing 80. An extension 85 of jaw 75 passes through an opening 86 of casing 80; this extension permits voluntary removal of a secured boot. To the end 33 of lever 31 is attached an enlarged end 87 of a flexible cable 88 which passes under a pulley or pin 89 pivoted or fixed on plate 1, then under a pulley 90 pivoted on the previously-described shaft 6, about a pulley 91 pivoted on jaw 75 and finally its second enlarged end 94 is fixed in a recess in plate 1.

If the plate 1 is lifted sufficiently away from ski 12, the lever 31 is actuated, as described for the first embodiment, by the projection (29) of drum 16. The end 33 of lever 31 exerts a traction on cable 88, jaw 75 tips in direction 82, and the sole 2 is freed, as before, prior to the end of possible movement of the plate 1, i.e. before the drum 16 is fully unwound. As soon as the projection (29) no longer bears against the end 30 of lever 31, all of the elements return to the position of FIG. 7 under the action of spring 81, and of the drum 16, and a ski boot can once more be fitted in the binding.

The ski binding according to the invention is applicable when it is desired that a binding with a spring-urged flexible cable release system retaining a sole-supporting plate should have a second security device allowing separation of a boot from the sole-supporting plate operable in the event of excessive forces acting, but which avoids the transmission of a very abrupt shock by the cable.

What is claimed is:

1. A safety ski binding comprising:

a boot sole gripping member pivotally supported at one end of a sole-supporting plate, said sole-supporting plate being elastically retained to a ski by a safety release device, said device including at least one flexible cable continuously tensioned by a cable tensioning device incorporated in said plate;

means for automatically opening said boot sole gripping member after operation of said safety release device comprising a movable actuating member operatively associated with said cable tensioning device, and transmission means carried by said plate and having an actuator element constructed and arranged to engage said actuating member at a predetermined position on the path of movement of said actuating member to cause said gripping member to pivot to an open position before the limit of movement of said sole-supporting plate relative to said ski.

2. A ski binding according to claim 1 which further includes a second elastic cable tensioning device associated with a second flexible cable elastically retaining said plate to said ski, said second cable tensioning device also including a second movable actuating member constructed and arranged to engage a second actuator element of said transmission means.

3. A ski binding according to claim 1 wherein said transmission means includes a flexible cable having a lever at one end arranged to engage said actuating member and bolt means at its other end associated with said sole gripping member, said bolt means normally maintaining said sole gripping member in a closed position but allowing said sole gripping member to pivot to an open position when said lever engages said actuating member; and biasing means arranged to urge said bolt means to a position maintaining said sole gripping member in a closed position.

4. A ski binding according to claim 1 wherein said transmission means includes a rigid element having bolt means at one end normally maintaining said sole gripping member in a closed position, said rigid element being slidable by engagement with said actuating member to allow said sole gripping member to pivot to an open position; and biasing means associated with said rigid element arranged to urge said bolt means to a position maintaining said sole gripping member in a closed position.

5. A safety ski binding which comprises:

a boot-sole supporting plate;

first and second elongated cables;

means securing an end of each of said cables to a ski;

front and rear cable tensioning devices incorporated in said plate, said front cable tensioning device including a rotatable drum to which is secured the other end of said first cable, said rear cable tensioning device including a rotatable drum to which is secured the other end of said second cable, means associated with said drums for exerting a continuous tension on said cables, said drums being rotatable between a first position at which the associated cable is fully retracted and said plate is held to said ski and a second position at which the associated cable is fully withdrawn and said plate is separated from said ski, at least one of said drums including a peripheral projection;

a boot-sole heel gripping assembly comprising a support pivotally mounted to the rear of said plate, a heel grip pivotally mounted to said support and movable between a first position for gripping a boot sole and a second position allowing release of said boot sole, an biasing means arranged to urge said grip to its first position, said assembly being movable between a first position wherein said grip engages said boot sole and a second position wherein said grip disengages said boot sole;

bolt means movably arranged within said plate to engage and normally maintain said assembly in its first position;

biasing means positioned within said plate to urge said bolt means into engagement with said assembly; and transmission means associated with said bolt means constructed and arranged to engage said peripheral projection when said drum approaches its second position to disengage said bolt from said assembly whereby said assembly is free to pivot to its second position.

6. A safety ski binding comprising:

a boot-sole supporting plate;

a boot-sole gripping member movably mounted on an end of said plate between a first position for gripping a boot sole on the plate and a second position allowing release of a boot sole from the plate;

means for releasably locking said boot-sole gripping member in its first position;

an elongated flexible cable;

means for securing an end of said cable to a ski;

a cable tensioning device incorporated in said plate, said device comprising means for continuously tensioning said cable, said device including an actuating member movable between a first extreme position in which said cable is fully retracted to hold said plate on said ski and a second extreme position in which said cable is fully withdrawn to allow a maximum separation of said plate from said ski;

and transmission means associated with said locking means, said transmission means being constructed and arranged for actuation by said actuating member in response to movement thereof towards said second extreme position but before arrival in said second extreme position to release said locking means to permit movement of said boot-sole gripping member from said first sole-gripping position to said second position thereof.

7. A ski binding according to claim 6, in which said locking means comprises bolt means engageable with said boot-sole gripping member to positively hold it in its first position, and said movable actuating member is a peripheral projection on a rotatable drum, said transmission means comprises a lever tippable by said projection in response to rotation of said drum towards said second extreme position, and a transmission member connecting said lever to said bolt means.

8. A safety ski binding comprising:

a boot-sole supporting plate;

a boot-sole gripping member movably mounted on an end of said plate between a first position for gripping a boot-sole on the plate and a second position allowing release of a boot-sole from the plate;

spring means arranged to bias said boot-sole gripping member into its first position;

an elongated flexible cable;

means for securing an end of said cable to a ski;

a cable tensioning device incorporated in said plate, said device comprising means for continuously tensioning said cable includng an actuating member movable between a first extreme position in which said cable is fully retracted to hold said plate on said ski and a second extreme position in which said cable is fully withdrawn to allow a maximum separation of said plate from said ski;

and transmission means connected to said boot-sole gripping member, said transmission means being constructed and arranged for actuation by said actuating member in response to movement thereof towards said second extreme position but before arrival in said second extreme position to move said boot-sole gripping member from its first to its second position against the action of said spring biasing means.

* * * * *